United States Patent [19]

Naulin et al.

[11] Patent Number: 4,465,909

[45] Date of Patent: Aug. 14, 1984

[54] SWITCHING DEVICE AND ITS USE IN A SELECTOR SWITCH OR A PROGRAM CONTROL APPARATUS

[75] Inventors: Michel Naulin, Angouleme; Michel Gendre, L'Isle d'Espagnac, both of France

[73] Assignee: La Telemecanique Electrique, France

[21] Appl. No.: 413,183

[22] Filed: Aug. 30, 1982

[30] Foreign Application Priority Data

Sep. 1, 1981 [FR] France ..... 81 16624

[51] Int. Cl.[3] ..... H01H 9/00

[52] U.S. Cl. ..... 200/5 R; 74/568 M; 200/29; 200/307

[58] Field of Search ..... 200/153 T, 5 R, DIG. 29, 200/307; 74/568 M; 307/141; 200/38 B, 38 BA, 38 CA, 11 R, 16 R

[56] References Cited

U.S. PATENT DOCUMENTS

| | | | |
|---|---|---|---|
| 3,057,224 | 10/1962 | Svaty et al. | 74/568 M |
| 3,082,644 | 3/1963 | Wallace, Jr. | 74/568 M |
| 3,151,500 | 10/1964 | Kurz | 74/568 M |
| 4,184,134 | 1/1980 | Kane et al. | 200/307 |
| 4,306,123 | 12/1981 | Taylor | 200/307 |

*Primary Examiner*—E. A. Goldberg
*Assistant Examiner*—Morris Ginsburg
*Attorney, Agent, or Firm*—William A. Drucker

[57] ABSTRACT

The movable contact (52) of an on-off switch is moved, through drive means (5), by balls (4) rotated by a disc (23) in the peripheral surface of which regularly spaced cavities are provided to accomodate the balls. The balls can be either withdrawn or inserted through a channel or bore (20) which can be closed by a plug (7) so that the switching pattern can be varied depending upon the angular position of the disc. The device can be used e.g. in a selector switch or a program control apparatus.

6 Claims, 5 Drawing Figures

SWITCHING DEVICE AND ITS USE IN A SELECTOR SWITCH OR A PROGRAM CONTROL APPARATUS

BACKGROUND OF THE INVENTION

The invention relates to a multi-position electrical switching apparatus including, within a casing: a rotary disc adapted to be rotated about a rotation axis by actuating means and having in its peripheral surface a plurality of cavities each adapted to accomodate an interlocking member, and at least one on-off switch provided with operating means cooperating with respective interlocking members in particular angular positions of the disc.

THE PRIOR ART

There is already known, e.g. from U.S. Pat. No. 3,151,500, an electrical apparatus having the above-defined construction. In addition to the fact that such an apparatus uses a predetermined number of discs which are all actuated by a single drive shaft and thus the number of switches actuated by the apparatus may be either too great or too small for some uses, it should be noted that the disc must be made within very severe manufacturing tolerances, in view of the fact that the balls are therein retained only due to resilience of a ring, which resilience must be quite accurately selected so that the retaining force is not higher than the force to be exerted through a special removing tool.

Moreover, it should be noted that the arrangement of the switches associated with the discs results in an excessive transverse dimension for the apparatus, which may be a drawback whenever such apparatus are to be arranged side-to-side, e.g. on a panel or in a shell or casing for control of electrical installations.

OBJECT OF THE INVENTION

Accordingly, it is an object of the invention to provide a switching apparatus having a reduced transverse dimension, which does not require manufacture of too precisely-dimensioned parts, which can be made in units form and which does not require use of a special tool whenever the user desires to set the operating cycle of the various switches in a particular combination of positions.

SUMMARY OF THE INVENTION

In accordance with the invention, this object is achieved due to the fact that the above-mentioned interlocking members are retained within the disc cavities through guide means provided by a cylindral surface of a bore of the casing which accomodates the disc, the above-mentioned operating means being resiliently biased against said interlocking members away from said rotation axis and in a direction parallel to the plane of the disc.

There are also known multi-position electrical switching apparatus provided with rotary drive means, wherein an on-off switch is accomodated, together with means for actuating it, in a unit casing or contact unit capable to become coaxially combined with other identical casings so that the apparatus can meet with the various requirements of the user. In such apparatus, in order to make selection of the operating sequence of a particular switch during a full revolution of the drive means, a cam already present in said unit casing is replaced with a cam having a shape corresponding to the desired sequence; as such a required replacement can only be effected upon manufacture and before the various unit casings be combined with each other, the user is not able to set or change either the order or the duration of the switch sequences.

Although said replacement can also be effected by axially moving all the cams out from the combined unit casings, this is not fully satisfactory to the user because, in order to replace a cam inserted between several other cams, said cams must be removed, which removal can result in a failure to restore the original disposition and orientation of the cams.

Also, in accordance with the present invention, there are provided means for improving both handling safety and operation of the apparatus by the user thereof.

A particularly advantageous application of the invention consists in a selector switch or a program control apparatus including a plurality of switching devices arranged over each other so that the upper surface of one device is in engagement with the lower surface of the device immediately thereabove, and a catching device provided with means for meshing with any one of the ends of a hub of a switching device.

BRIEF DESCRIPTION OF THE DRAWINGS

Other features and advantages of the present invention will become clear from the disclosure hereinbelow taken with reference to the appended drawings, in which.

and

Figure 5:
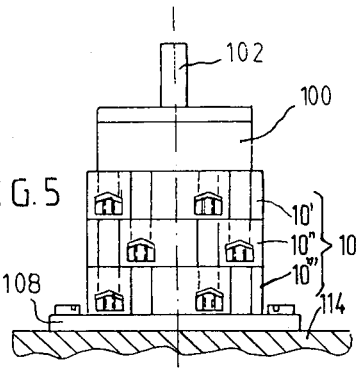

FIG. 5 is a front view of a selector switch using a plurality of switching devices and accomodated within the bottom of a shell.

DESCRIPTION OF THE PREFERRED EMBODIMENT

Figure 3:
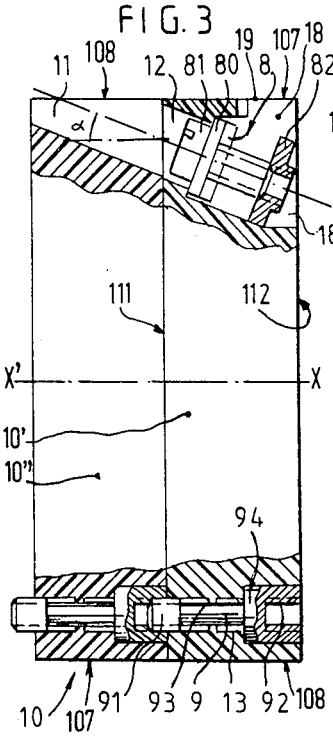
FIG. 3 is a partial cross-sectional view, along line AB of FIG. 2, through two switching devices one of which is arranged over the other.
Figure 2:
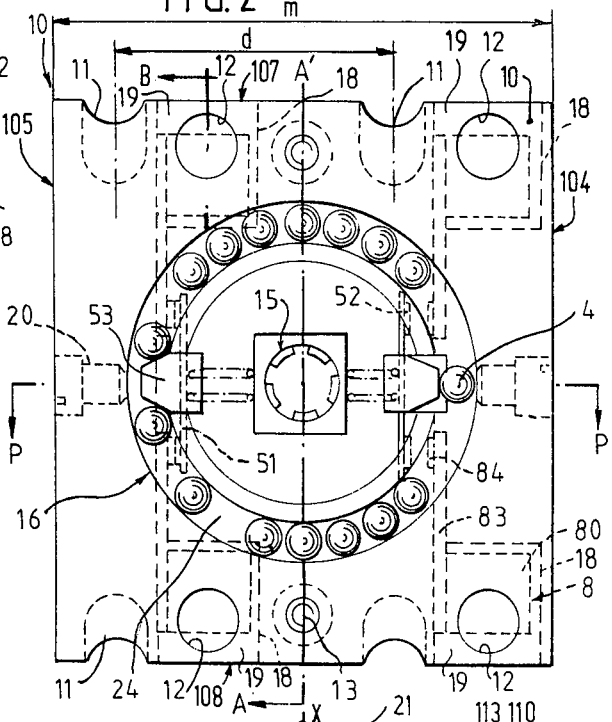
FIG. 2 is a top view of said switching device.
Figure 1:
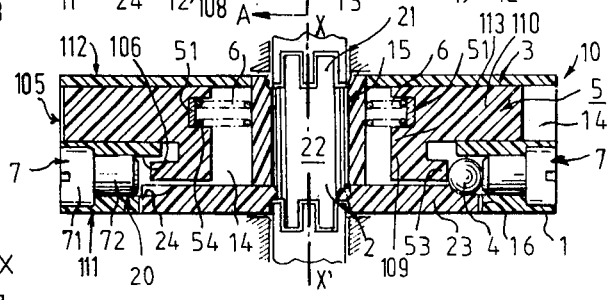
FIG. 1 is a cross-sectional view, along line PP of FIG. 2, through a switching device or contact unit in accordance with a preferred embodiment of the invention, in which the interlocking members comprise balls.

FIGS. 1, 2 and 3 each illustrate a contact unit 10 including an insulated casing 1 having a parallelepipedic shape and provided with a cover 3 secured to the casing, e.g. by screws (not shown).

Casing 1 includes, on each side of a middle plane AA' extending parallel to two opposite side surfaces 104, 105, a housing 14 for accomodating a movable member 5 and guiding the latter in its translation movements (FIG. 1).

Casing 1 further includes a central bore 15 and a lower bore 16 provided in the bottom of the casing both concentric to a rotation axis XX'. The first bore acts as a bearing for the hub 22 of a rotary member 2, and the second bore is designed to accomodate a disc 23 integral with hub 22 (FIG. 1). Rotary member 2 has at the opposite ends of its hub 22 a notched surface 21 protruding from the casing. Disc 23 has in its peripheral surface a plurality of cavities 24 in the form of portions of sphere (see FIG. 1) regularly spaced about its periphery and so spaced from each other that they form housings for balls 4 with bore 16 and with an upper wall surface 106 which forms an annular track parallel to the disc. Rotary member 2 is secured to the casing against any translation movement by any means known per se and which are not illustrated. Upon rotation of member 2, the balls are guided by bore 16 and surface 106 and are subjected to a circular translation by cavities 24 of disc 23.

Movable member 5 is made e.g. of an insulating material and is produced by a molding process. Its shape matches with housing 14 through which it is slidable. The movable member, as shown in FIG. 1, has: a short, first portion 109 orthogonal to rotation axis XX' of the hub and arranged at the ball level in a plane parallel to transverse sides 111, 112 of the casing; a longer, second portion 110 also orthogonal to said rotation axis is extending in a plane parallel to the disc surface, and an intermediate portion 113 connecting the other two portions in a direction parallel to rotation axis XX'. The first portion has a trapezoidally-shaped head 53 abutting against the balls by the force of a spring 6 located in a groove 54 provided in the second portion of the movable member, on the side directed towards the hub of the switch and bearing against a wall which forms the bearing 15; thus, balls 4 are resiliently biased against bore 16 whenever head 53 is brought into alignment with one of them, respectively.

Spring 6 urges toward the bottom of groove 54 a contact bridge 51 having at each of its opposite ends a contact patch such as 52. Bridge 51 and patches 52 form a switch movable contact integral with movable member 5.

On each side of a plane of symmetry PP orthogonal to plane AA', two pairs of fixed contact patches such as 84 are connected, by two pairs of conducting straps such as 83 which are integral with casing 1, to two pairs of connectors such as 8, respectively, located on each side of plane AA' and adjacent to side surfaces 107, 108 of the case which are parallel to plane PP. The four connectors 8, of the clevis-screw type which is known per se, are located in housings, such as 18, of case 1 (see FIG. 3). They include e.g. a small plate 80 integral with strap 83 and a screw 81 passing through a bore provided in plate 80 and threadable into a movable clevis 82.

Each housing 18 of case 1 is provided with a cylindrical bore 12 opening towards a transverse surface 111 of the case and having a symmetry axis which makes an angle $\alpha$ with the rotation axis of hub 22 and with plane PP, as shown in FIG. 3.

Angle $\alpha$ is preferably from 15 to 60 degrees. Housing 18 opens through an opening 19 (FIGS. 3 and 4) provided in side surface 107 of the case parallel to symmetry plane PP, so that wires to be connected to connector 8 can be inserted therein.

On each side of plane AA', a movable contact bridge 51 provided with contacts 52 is thus associated to a pair of fixed straps 83 located on each side of plane PP and provided with their respective fixed contacts 84, the whole assembly forming an on-off switch.

On each side of plane AA' and in each side surface 107, 108 parallel to plane PP, case 1 is provided with a sloping groove 11 the longitudinal dimension of which makes also an angle $\alpha$ with the rotation axis of hub 22. Each of the four grooves 11 is arranged, as shown in FIG. 3, so that when two wafers are stacked over each other after one of them has been subjected to angular movement through 180° about rotation axis XX' with respect to the other, symmetry axes of grooves 11 of one switching device (10' or 10'') are in alignment with the symmetry axes of cylindrical bores 12 (FIG. 3) of the other switching device, and conversely. Each groove 11 forms a guide surface for a screwdriver by which the screw of a particular connector 8 can be tightened or loosened.

Position of those grooves 11, bores 12 and housings 18 which are located on one side of plane AA' can be derived from position of those grooves 11, bores 12 and housings 18 which are located on the opposite side of plane AA' by a translation movement towards the opposite side of plane AA' through a distance "d", e.g. equal to half the width "m" of the case.

Casing 1 is further provided with a pair of opposite bores, such as 20, the axes of symmetry of which extend within plane PP and are in alignment with the center points of balls 4 whenever the latter are brought into alignment therewith; said bores open both into bore 16 and towards corresponding side surfaces 104, 105.

The portion of bore 20 which opens towards a side surface such as 105 is internally threaded so as to accomodate threaded portion 71 of a screw serving as a plug 7 and including a cylindrical portion 72 the dimensions of which match with bore 20, the inner end of which is located at the guide surface provided by bore 16.

Casing 1 is also provided with a pair of drillings 13 (FIGS. 2 and 3) on each side of the symmetry axis of the hub and in plane AA', through which screws 9, the cylindrical head 94 of which is provided with an inner thread 92 for accomodating the threaded portion 91 of a screw making part of another device can be inserted when two or more devices (10', 10'') are combined with each other.

Figure 4:
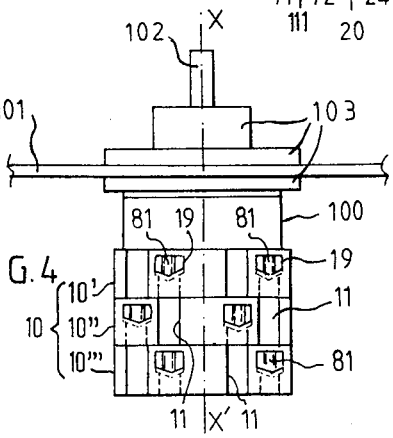
FIG. 4 is a front view of a selector switch using a plurality of switching devices and accomodated on a panel.

FIG. 4 illustrates a first method for assembly of a selector switch comprising a plurality of contact units 10', 10'', 10''' disposed over each other, the first 10' of which has a notched surface 21 by which it can be coupled with a matching notched surface provided on an angular indexing device 100 which is known per se and designed to give the various discs the number of stationary positions as desired for the selector switch. The whole assembly can be secured to a cover or control panel 101 by means of a device 103.

A drive shaft 102 or any other actuator for device 100 can be provided with either a control knob or a clockwork for converting the selector switch into a programmer apparatus. With the arrangement of components as shown in FIG. 4, it is clear that a screw-driver can be inserted into guide groove 11 of the intermediate wafer to engage the screw of the connecting member located in housing 19 of the upper wafer. It should also be clear that all the other screws can be reached even when the selector switch is installed and connected to conducting wires.

FIG. 5 illustrates another method for assembly of a selector switch comprising a plurality of contact units 10', 10'', 10''', wherein one unit is secured through screws to a support 108 by means of which the selector switch can be fastened e.g to bottom 114 of a shell. The number of contact units 10', 10'', 10''', etc . . . corresponding to the desired number of contact positions are stacked over each other while alternately angularly moving the units through 180° about the rotation axis.

In such an arrangement, the contact units have been rotated so that the connecting screws can be reached from the top. This is made feasible by notched surface 21 of rotary member 2 by means of which the notched surface corresponding to an upper surface of a wafer can equally be coupled with the notched surface corresponding to either an upper or lower surface of another unit. In this manner, the arrangement of FIG. 5 is achieved, which enables an operator to reach all the connecting points while leaving the assembly in place at bottom 114 of the shell.

In operation, whenever the control knob connected with shaft 102 is actuated, shaft 102 rotates indexing device 100 and rotary members 2 of each wafer. The rotary member sequentially brings each cavity 24 into positions where it is in alignment with head 53 of one movable member 5. In such a position, if the cavity carries a ball, movable member 5 is urged by the ball back towards axis XX' through head 53 and the contact is opened as shown in the right-hand half of FIGS. 1 and 2. On the other hand, if there is no ball in the cavity, head 53 is not urged back and the contact is closed as shown in the left-hand half of FIGS. 1 and 2.

It should be easily understood that various combinations of contact opening and closing sequences can be achieved by merely withdrawing or inserting balls through bores or channels 20.

In addition, by providing a number of cavities twice the number of stationary angular positions set by the indexing device 100, it can be provided overlapping switch circuits so arranged that between two stationary positions corresponding to two successive setting points, the contact of a first unit 10' will be closed before the contact of a second unit 10'' be opened. Thus, with the wafer selector switch as described and shown, selector switches or programmer apparatus providing any kinds of switching sequences can be constructed.

Disc 23 and hub 22 can be made of a transparent material so that the cavities containing a ball are visible and thus the positions in which switching actions occur can be determined.

It should be understood that any other application or modification which can be made by man skilled in the art are also included in the scope of the invention.

Thus, interlocking members in the form of small cylinders having axes either parallel or directed towards the rotation axis could be inserted into cavities having particular shapes; it should be obvious that the cross-sectional area of the casing channel through which such interlocking members would be inserted should also be matched with such particular shapes.

We claim:

1. A multi-position electrical switching unit comprising: a casing having top and bottom substantially parallel walls and top and bottom cylindrical bores respectively provided in said top and bottom walls; said top and bottom bores respectively having coaxially arranged cylindrical surface portions; a shaft rotatively mounted in the top bore and extending within the casing; a disc integrally located in the bottom bore and coaxially connected to the shaft, said disc having, on an inner face thereof, a plurality of peripheral regularly distributed cavities; an annular track arranged within said casing in a plane parallel to said disc; a plurality of individually removable interlocking members adapted to be retained in the respective cavities and, when the disc is rotated, to be subjected to a circular translational motion from one position to another, while being guided along the cylindrical surface portion of the bottom bore and along the annular track; indexing means for sequentially driving the shaft into a plurality of indexed angular positions through successive steps of rotation; at least one switch having fixed contact means and movable contact means mounted in said casing; at least one operating member mechanically connected to said movable contact means and mounted for sliding motion in said casing along a direction substantially parallel to said disc, from a first position in which the movable contact means engages the fixed contact means to a second position in which the movable contact means is disengaged from the fixed contact means, the operating member being more remote from the shaft in the first position than in the second position; resilient means for resetting the operating member into the first position, the operating member having a projecting surface portion which is in register with one specific cavity for each of the said indexed angular positions of the shaft, said projecting surface portion being so shaped as to abut against the interlocking member when the interlocking member is present in the said specific cavity and thus assume its second position and to be reset into its first position when no interlocking member is present in the said specific cavity.

2. An electrical switching unit according to claim 1, wherein said operating member has a first elongate portion carrying said movable contact means and a second portion which includes said projecting surface portion, said projecting surface portion having a trapezoidally-shaped cross-sectional area and being parallel to and shorter than said first portion and located adjacent to said disc.

3. An electrical switching unit according to claim 1, wherein said casing has, at right angles to said top and bottom walls, at least one side face which is provided with a channel opening towards said side face and into said bottom bore, said channel being adapted for introducing said interlocking members into said cavities, and removable plug means for closing said opening once the interlocking members have been introduced.

4. An electrical switching unit according to claim 1, further comprising at least a second unit assembled to the first unit, wherein the casing of each unit has two opposite side faces parallel to the common axis of symmetry of said bores and each provided with a pair of sloping grooves and a pair of housings, each unit having two switches provided with connecting terminals which are accomodated in the respective housings, a pair of openings adapted for introduction of a tightening tool leading to the respective housings through the top and bottom surfaces thereof, said grooves and openings being arranged with respect to said axis of symmetry in such a manner that, the casings of the first and second assembled units having been angularly displaced through 180° one with respect to the other about said axis before being coaxially assembled against each other along top and bottom walls thereof, the grooves in a first casing of the pair and the openings in a second casing of the pair are aligned along a common direction which makes a predetermined angle with the said axis.

5. The device according to claim 4, wherein the casing of each unit is provided with further openings and with fastening screws accomodated in said further openings and extending parallel to the common axis of symmetry of said bores, a bearing adapted to accomodate said shaft being integrally mounted in said casing, coupling means at the end of said shaft opposite to said disc, said screws and coupling means being so arranged that, in the assembly of said first and second units, the respective fastening screws are in engagement into each other and the respective coupling means cooperate with each other.

6. The device according to claim 1, wherein said interlocking members comprise balls.

* * * * *